US011028737B2

(12) United States Patent
Mitchum et al.

(10) Patent No.: US 11,028,737 B2
(45) Date of Patent: Jun. 8, 2021

(54) MECHANICAL RETENTION MEMBER FOR VALVETRAIN COMPONENTS

(71) Applicants: Cummins Inc., Columbus, IN (US); Gregory J. Mitchum, Franklin, IN (US); Steven M. Bellinger, Columbus, IN (US); Richard Gonzalez, Columbus, IN (US); Glen T. Haegele, Columbus, IN (US); Troy Boggs, Columbus, IN (US)

(72) Inventors: Gregory J. Mitchum, Franklin, IN (US); Steven M. Bellinger, Columbus, IN (US); Richard Gonzalez, Columbus, IN (US); Glen T. Haegele, Columbus, IN (US); Troy Boggs, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/765,057

(22) PCT Filed: Nov. 22, 2017

(86) PCT No.: PCT/US2017/062947

§ 371 (c)(1),
(2) Date: May 18, 2020

(87) PCT Pub. No.: WO2019/103733

PCT Pub. Date: May 31, 2019

(65) Prior Publication Data

US 2020/0355094 A1 Nov. 12, 2020

(51) Int. Cl.
*F01L 1/26* (2006.01)
*F01L 1/18* (2006.01)
(Continued)

(52) U.S. Cl.
CPC ..... *F01L 1/26* (2013.01); *F01L 1/181* (2013.01); *F02F 1/242* (2013.01); *F01L 1/2405* (2013.01); *F01L 2800/12* (2013.01)

(58) Field of Classification Search
CPC . F01L 1/26; F01L 1/181; F01L 1/2405; F01L 2800/12; F01L 1/14; F01L 1/143;
(Continued)

(56) References Cited

U.S. PATENT DOCUMENTS 2,363,220 A * 11/1944 Alcorn ..... F01L 1/16 123/90.47
2,385,959 A 10/1945 Yingling
(Continued)

OTHER PUBLICATIONS

International Search Report and Written Opinion issued by the ISA/US, Commissioner for Patents, dated Jan. 30, 2018 for International Application No. 2017/062947; 6 pages.

*Primary Examiner* — Hung Q Nguyen
(74) *Attorney, Agent, or Firm* — Faegre Drinker Biddle & Reath LLP

(57) ABSTRACT

A retention member is configured to be supported within a cylinder head of an engine and includes a body portion and a plurality of arms. The body portion has an opening configured to receive a fuel injector of the engine. Additionally, the plurality of arms extends from the body portion and is configured to be positioned over a portion of a cross-head of the engine. The plurality of arms is spaced apart from the cross-head during routine operation of the engine.

19 Claims, 7 Drawing Sheets

(51) Int. Cl.
*F02F 1/24* (2006.01)
*F01L 1/24* (2006.01)

(58) Field of Classification Search
CPC ..... F01L 1/18; F01L 1/185; F01L 2001/186; F01L 2001/187; F01L 1/262; F02F 1/242
See application file for complete search history.

(56) References Cited

U.S. PATENT DOCUMENTS

| | | | | | |
|---|---|---|---|---|---|
| 2,955,581 | A | * | 10/1960 | Fedak | F01L 1/183 123/90.42 |
| 3,198,183 | A | * | 8/1965 | Ball | F01L 1/183 123/90.42 |
| 3,401,678 | A | | 9/1968 | Rose | |
| 3,633,556 | A | | 1/1972 | Inoue | |
| 3,963,004 | A | | 6/1976 | Lysinger et al. | |
| 4,327,677 | A | | 5/1982 | Vander Bok | |
| 5,150,672 | A | | 9/1992 | Fischer et al. | |
| 5,645,025 | A | * | 7/1997 | Caya | F01L 1/183 123/193.5 |
| 5,671,707 | A | * | 9/1997 | Purcell | F01L 1/181 123/90.37 |
| 6,962,134 | B1 | * | 11/2005 | Douse | F01L 1/18 123/195 A |
| 7,878,166 | B2 | | 2/2011 | Wotherspoon et al. | |
| 2007/0209623 | A1 | * | 9/2007 | Klotz | F01L 1/14 123/90.48 |
| 2011/0017160 | A1 | * | 1/2011 | Kishi | F01L 1/2405 123/90.45 |

* cited by examiner

MECHANICAL RETENTION MEMBER FOR VALVETRAIN COMPONENTS

CROSS-REFERENCE TO RELATED APPLICATIONS

The present application is a national stage application of International (PCT) Patent Application Serial No. PCT/US2017/062947, Nov. 22, 2017, the complete disclosure of which is expressly incorporated by reference herein.

FIELD OF THE INVENTION

The present invention relates generally to retaining a position of various valvetrain components and, more particularly, to mechanically retaining valvetrain components positioned within a cylinder head of an engine.

BACKGROUND OF THE DISCLOSURE

A valvetrain assembly for an engine may include a small clearance between a valve and a rocker arm or cam follower. This small clearance therebetween allows for thermal expansion of one or more of the parts without causing the components to interfere with each other during operation of the engine. However, this small clearance also may cause some noise and wear as the parts contact each when the engine is operating.

To allow for operation of the valvetrain components while minimizing noise and wear due to the small clearance provided between a valve and its associated rocker arm or cam follower, a hydraulic lash adjuster may be used. More particularly, the hydraulic last adjuster may be provided to compensate for the small clearance between such components, thereby allowing the valvetrain assembly to operate with minimal or zero clearance between the valve and its associated rocker arm or cam follower. However, if the hydraulic lash adjuster fails or operates incorrectly (e.g., excessive lash caused by loss of hydraulic fluid or a slow-to-respond lash adjuster in cold temperatures), the cross-head of the valvetrain assembly may fall off of the tips of the valves, thereby causing misfire and/or damage to the engine.

However, if the valvetrain assembly includes a mechanism to retain the position of the cross-head during a failure or incorrect operation of the lash adjuster, additional mass or weight is undesirably added to the valvetrain assembly which may affect the operating speed of the engine. Alternatively, software may be used to electronically or otherwise control the position of the cross-head during a failure of the lash adjuster, but this increases the complexity of the overall engine system and may introduce an additional failure mechanism to the engine if the software and/or electronics were to operate incorrectly.

As such, there is a need for a separate mechanism configured to retain the cross-head on the tips of the valves even during a failure or incorrect operation of the lash adjuster. Additionally, such a mechanism should not interfere with normal or routine operation of the engine and allow for the necessary movement of the cross-head for operating the valves.

SUMMARY OF THE DISCLOSURE

In one embodiment, a retention member is configured to be supported within a cylinder head of an engine and comprises a body portion and a plurality of arms. The body portion has an opening configured to receive a fuel injector of the engine. Additionally, the plurality of arms extends from the body portion and is configured to be positioned over a portion of a cross-head of the engine. The plurality of arms is spaced apart from the cross-head during routine operation of the engine.

In another embodiment, a retention member is configured to be operably coupled a valvetrain assembly of an engine and comprises a body portion positioned intermediate a first valve and a second valve of the valvetrain assembly. The retention also comprises a first plurality of arms configured to be positioned relative to the first valve and a second plurality of arms configured to be positioned relative to the second valve. The body portion, first plurality of arms, and second plurality of arms are stationary relative to movement of the first and second valves.

In a further embodiment, an engine comprises a cylinder having a body portion and a cylinder head configured to be coupled with the body portion. The engine also comprises a valvetrain assembly supported on at least a portion of the cylinder and including an intake valve, an exhaust valve, a first cross-head operably coupled to the intake valve, and a second cross-head operably coupled to the exhaust valve. The engine also comprises a retention member configured to maintain a position of the cross-heads relative to the intake and exhaust valves. The retention member is removable relative to the cross-heads.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1A:
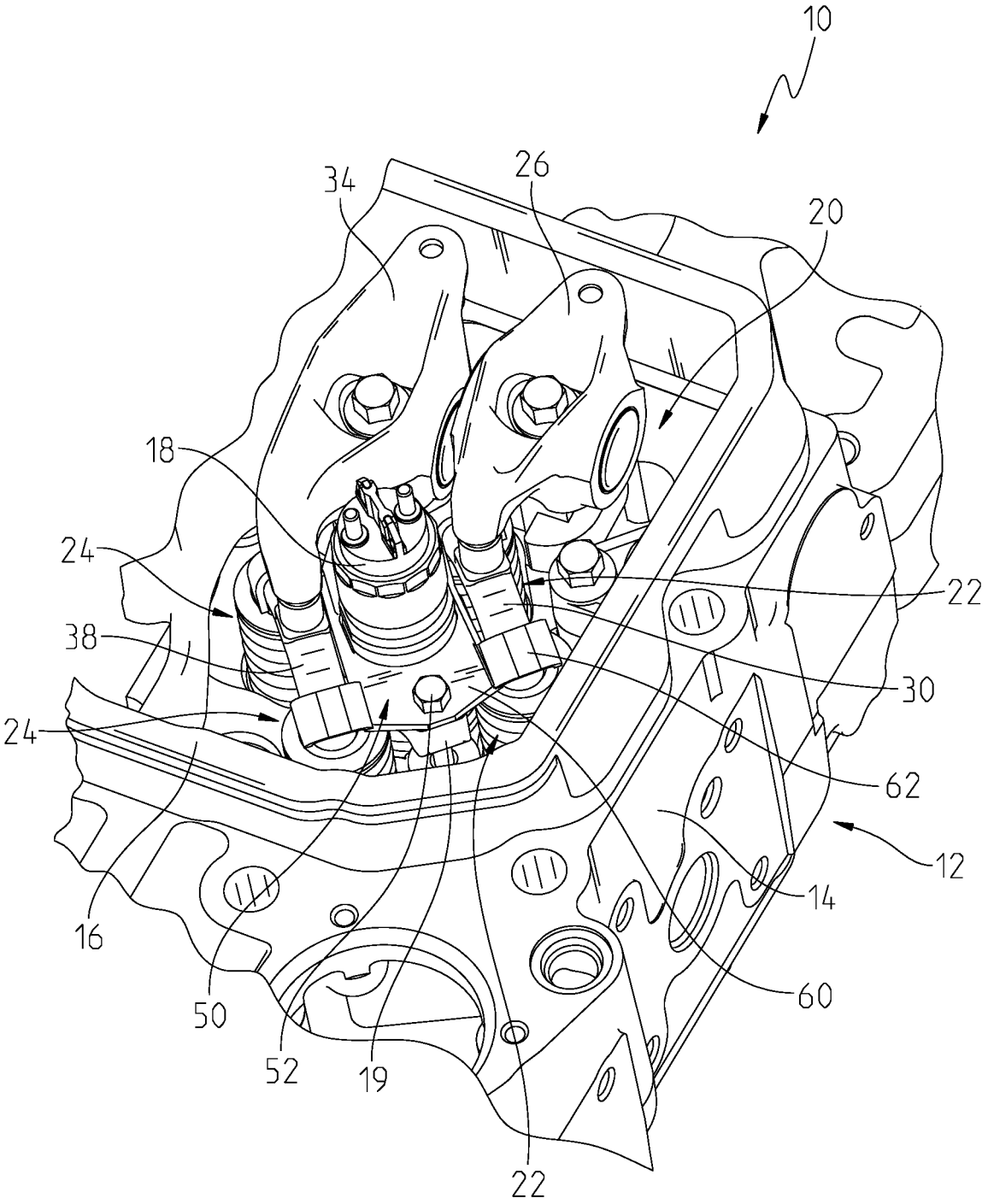
FIG. 1A is a perspective view of a cylinder of an engine including a portion of a valvetrain assembly positioned within a cylinder head portion of the cylinder.
Figure 1B:
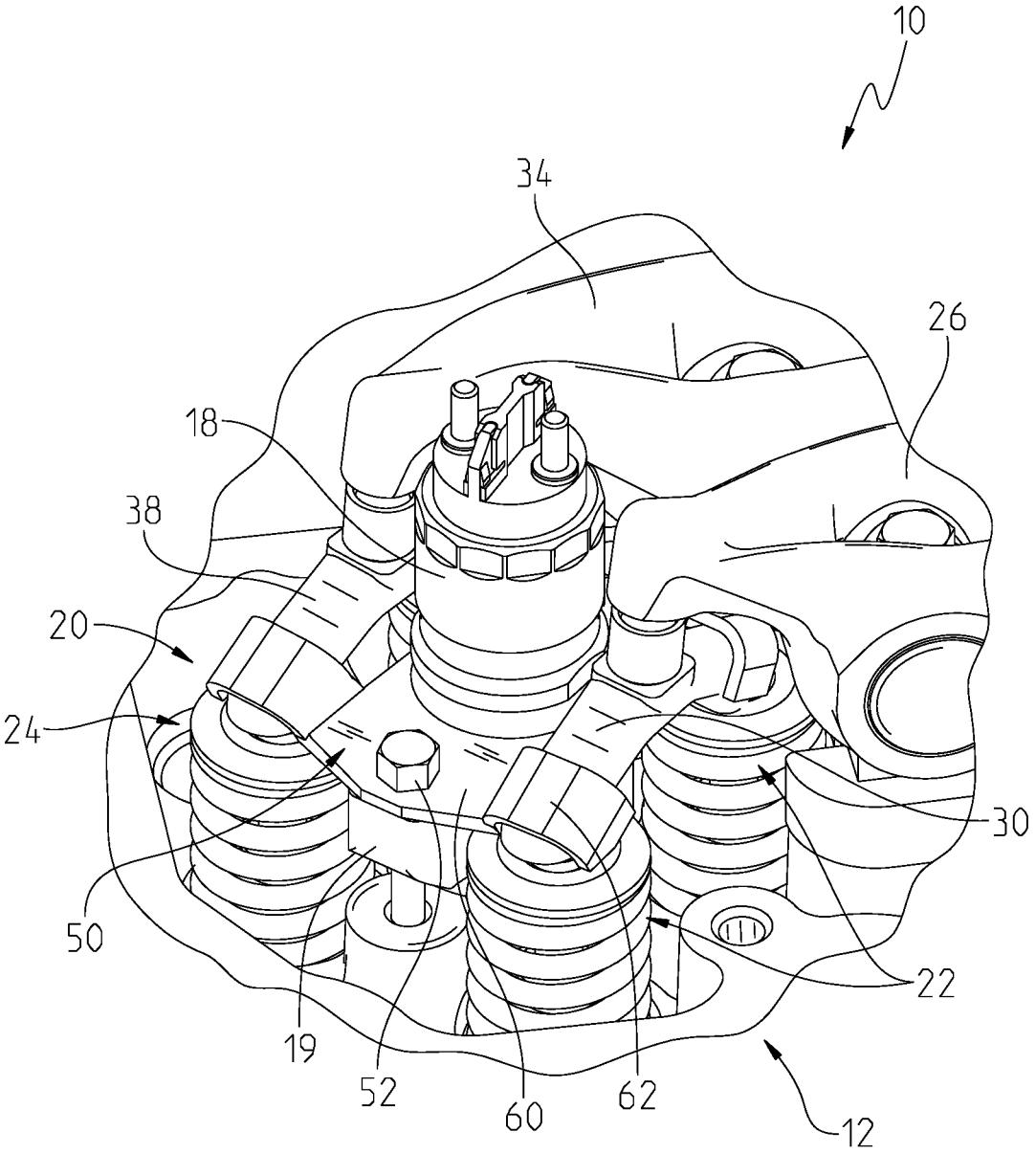
FIG. 1B is another perspective view of the cylinder and valvetrain assembly of FIG. 1A.
Figure 2:
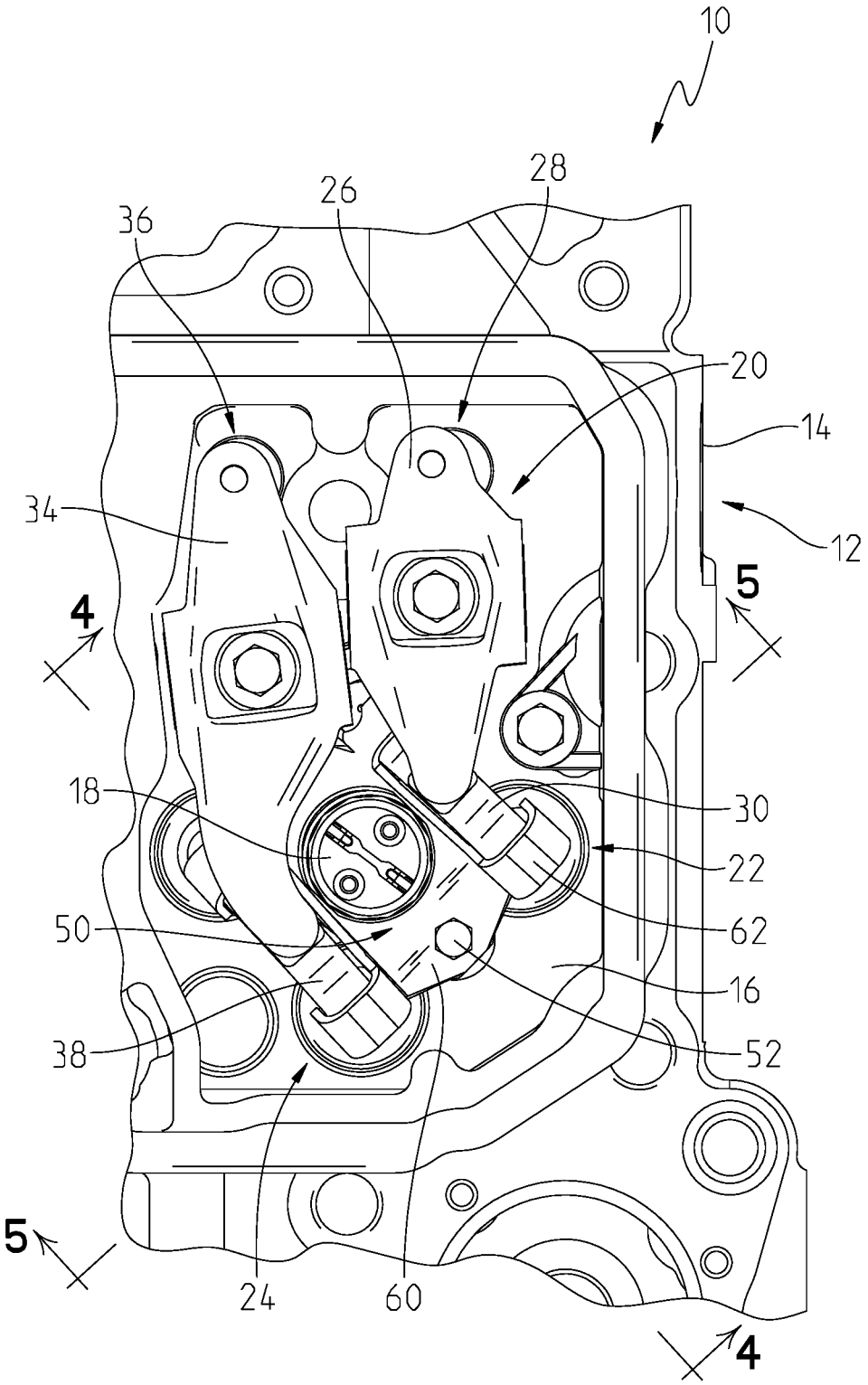
FIG. 2 is a top view of the cylinder of FIG. 1A.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principals of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Referring to FIGS. 1A-5, a portion of an internal combustion engine 10 is shown. Engine 10 includes at least one cylinder 12 having a cylinder body portion 14 and a cylinder head portion 16. Cylinder 12 supports a fuel injector 18 and a portion of a valvetrain assembly 20. Fuel injector 18 is configured to be supported on cylinder 12 and, more particularly, on cylinder head portion 16, with a clamp 19, as shown best in FIG. 3. Valvetrain assembly 20 is configured to operate with rotation of a crankshaft (not shown) of engine 10 to facilitate combustion within a combustion chamber of cylinder 12.

Illustratively, and as shown in FIGS. 1A-5, valvetrain assembly 20 includes an intake valve 22 and an exhaust valve 24. Intake valve 22 is operably coupled to an intake rocker arm 26 which is configured to pivot or otherwise move in response to reciprocating motion of an intake pushrod 28. More particularly, an intake cross-head 30 is positioned longitudinally intermediate (e.g., generally vertically between) a tip 32 of intake valve 22 and intake rocker arm 26. In this way, as intake pushrod 28 moves in a generally upward direction, intake rocker arm 26 pivots in a direction to push downwardly on intake cross-head 30, thereby opening intake valve 22 during a predetermined portion of a combustion cycle. As such, intake cross-head 30 is configured for a predetermined range of movement during normal or routine operation of engine 10 such that intake cross-head 30 moves only as needed to open and close intake valve 22 but does not have extreme or excessive movement outside of the predetermined range of movement during routine of engine 10.

Similarly, and referring still to FIGS. 1A-5, exhaust valve 24 is operably coupled to an exhaust rocker arm 34 which is configured to pivot or otherwise move in response to reciprocating motion of an exhaust pushrod 36. More particularly, an exhaust cross-head 38 is positioned longitudinally intermediate a tip 40 of exhaust valve 24 and exhaust rocker arm 34. In this way, as exhaust pushrod 36 moves in a generally upward direction, exhaust rocker arm 34 pivots in a direction to push downwardly on exhaust cross-head 38, thereby opening exhaust valve 24 during a predetermined portion of a combustion cycle. As such, exhaust cross-head 38 is configured for a predetermined range of movement during normal or routine operation of engine 10 such that exhaust cross-head 38 moves only as needed to open and close exhaust valve 24 but does not have extreme or excessive movement outside of the predetermined range of movement during routine of engine 10.

Figure 3:
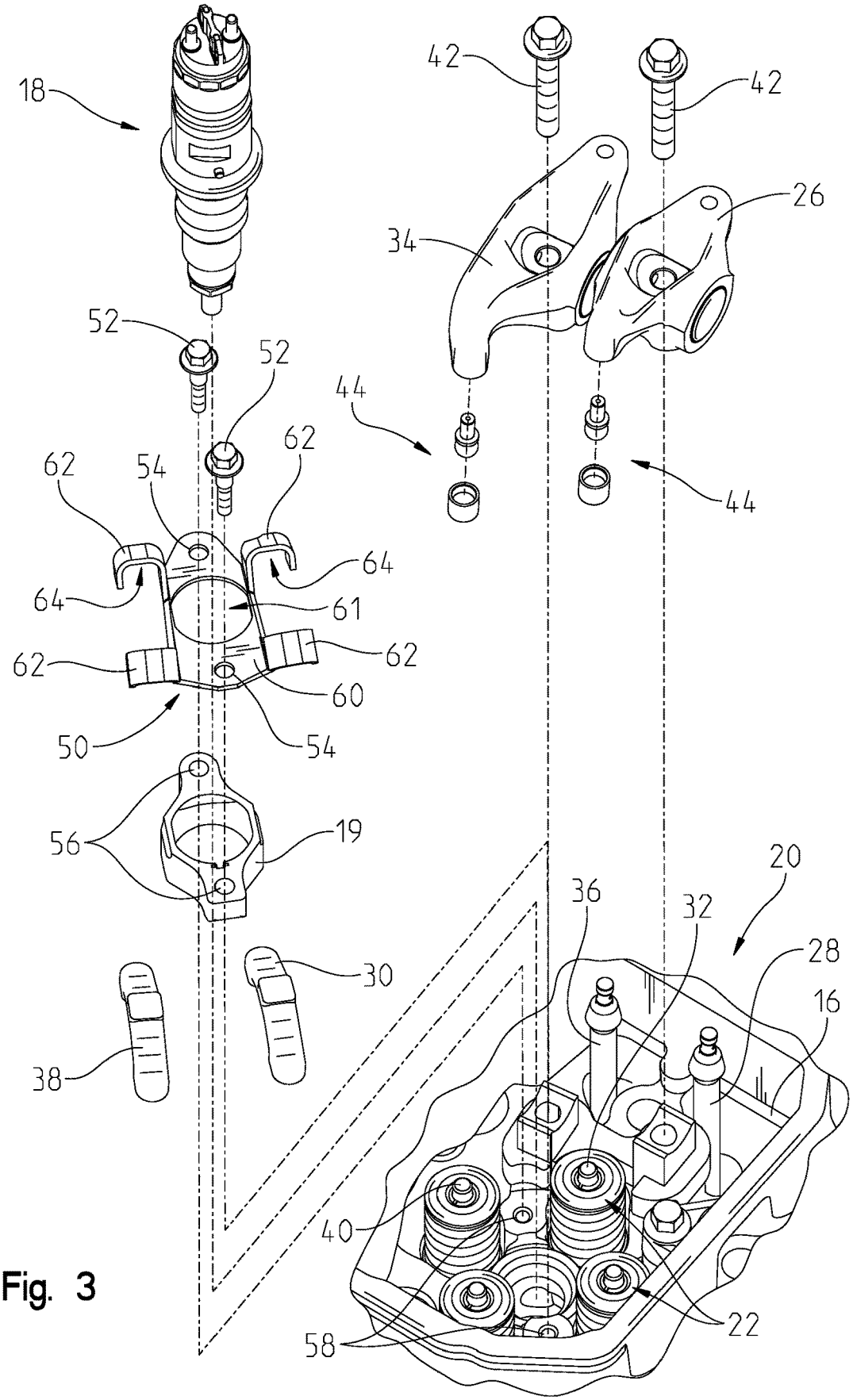
FIG. 3 is an exploded view of the portion of the valvetrain assembly of FIG. 1A, including a mechanical retention member.

Referring to FIG. 3, each of rocker arms 26, 34 is coupled to cylinder head portion 16 with fasteners 42. Additionally, each rocker arm 26, 34 includes a tappet assembly 44 configured to contact tips 32, 40 of intake valve 22 and exhaust valve 24, respectively. In operation, tappet assemblies 44 are configured to contact cross-heads 30, 38 when opening intake valve 22 and exhaust valve 24, respectively. To minimize any clearance between tappet assemblies 44 and cross-heads 30, 38 and also to minimize any clearance between cross-heads 30, 38 and tips 32, 40 of intake valve 22 and exhaust valve 24, respectively, valvetrain assembly 20 may include a hydraulic lash adjuster (not shown) associated with each valve 22, 24. The hydraulic lash adjuster is configured to accommodate any clearances between tappet assemblies 44 and cross-heads 30, 38 and any clearances between cross-heads 30, 38 and valves 22, 24, respectively, to minimize noise and wear at these components during operation of valvetrain assembly 20.

However, if the hydraulic lash adjuster has a failure, for example a loss of hydraulic fluid and/or pressure, or operates incorrectly, for example is slow to respond during cold temperatures, the hydraulic lash adjuster may cause excessive movement of cross-heads 30, 38. More particularly, such excessive movement of cross-heads 30, 38 is defined as any movement of cross-heads 30, 38 outside of the predetermined range of movement during normal or routine operating conditions of engine 10. In this way, if the hydraulic lash adjuster fails or operates incorrectly, engine 10 no longer operates according to normal or routine operating conditions and cross-heads 30, 38 may move excessively and outside of the predetermined range of movement. In such instances, if failure or incorrect operation of the hydraulic lash adjuster causes excessive movement of cross-heads 30, 38, cross-heads 30, 38 can fall off of valve tips 32, 40, respectively, leading to misfire during a combustion cycle and possible damage to engine 10.

The present disclosure addresses such concerns by providing a retention member 50, as shown in FIGS. 1A-6. Retention member 50 may be comprised of a metallic material and may be formed through a stamping process. For example, retention member 50 may be comprised of a steel material, such as AISI 1010 steel and/or ASTM A572 grade 50 steel.

It may be appreciated that retention member 50 is provided as a separate component from valvetrain assembly 20 such that retention member 50 is not defined as a part of valvetrain assembly 20. More particularly, and as shown best in FIG. 3, retention member 50 is removably coupled to a portion of cylinder head portion 16 through fasteners 52. Illustratively, fasteners 52 removably couple retention member 50 to clamp 19 of fuel injector 18 and are received through apertures 54 of retention member 50 and apertures 56 of clamp 19 and are coupled with mounting bores 58 of cylinder head portion 16. Illustratively, fasteners 52 are threadedly coupled to cylinder head portion 16 but may be otherwise removably coupled thereto. By removably coupling retention member 50 to static components of engine 10, such as clamp 19 and cylinder head portion 16 which do not move during operation of engine 10, retention member 50 also is configured to maintain a static or fixed position during operation of engine 10. As disclosed further herein, retention member 50 is not configured to contact any moving portion of engine 10, including valvetrain assembly 20, unless cross-heads 30, 38 have excessive movement or lash, in which case, retention member 50 is configured to maintain cross-heads 30, 38 on valve tips 32, 40, respectively.

Retention member 50 includes a body portion 60 having apertures 54 for fasteners 52 and a plurality of arms 62 extending from body portion 60. Illustratively, as shown in at least FIG. 5, body portion 60 is positioned intermediate or between valves 22, 24. Body portion 60 includes an aperture 61 configured to receive a portion of fuel injector 18 therethrough. Body portion 60 also may include an alignment or guide tab (not shown) to facilitate correct positioning of retention member 50 on cylinder head portion 16. For example, with such an alignment or guide tab, if retention member 50 is positioned incorrectly on cylinder head portion 16, the alignment or guide tab would interfere with rocker arms 26, 34. As such, during assembly of retention member 50 on cylinder head portion 16, the alignment or guide tab ensures correct positioning of retention member 50 without interfering with other components of valvetrain assembly 20.

Arms 62 of retention member 50 may be integrally formed with body portion 60 or may be coupled thereto using conventional coupling mechanisms and methods. Illustratively, retention member 50 includes four arms 62, with two arms associated with intake valve 22 and two arms associated with exhaust valve 24. In one embodiment, arms 62 each defines an upside-down "U" shape. More particularly, the upside-down "U" shape defines a recessed portion 64 of each arm 62. As shown in FIGS. 1-5, a portion of cross-heads 30, 38 which positioned directly above or over valve tips 32, 40, respectively, is positioned within recessed portion 64 of each arm 62 such that arms 62 are positioned directly over or above the portion of cross-heads 30, 38 on respective valve tips 32, 40. The upside-down "U" shape of arms 62 allows arms 62 to generally extend around a portion of cross-heads 30, 38, such that vertical, lateral, and rotational movement of cross-heads 30, 38 outside of a predetermined range of movement during normal or routine operation of engine 10 would be prevented. More particularly, if cross-heads 30, 38 were to move off of valve tips 32, 40, respectively, during a failure or incorrect operation of engine 10, cross-heads 38 would contact arms 62 but the shape and position of arms 62 maintains the position of cross-heads 30, 38 on valve tips 32, 40, respectively, as disclosed further herein.

Figure 4:
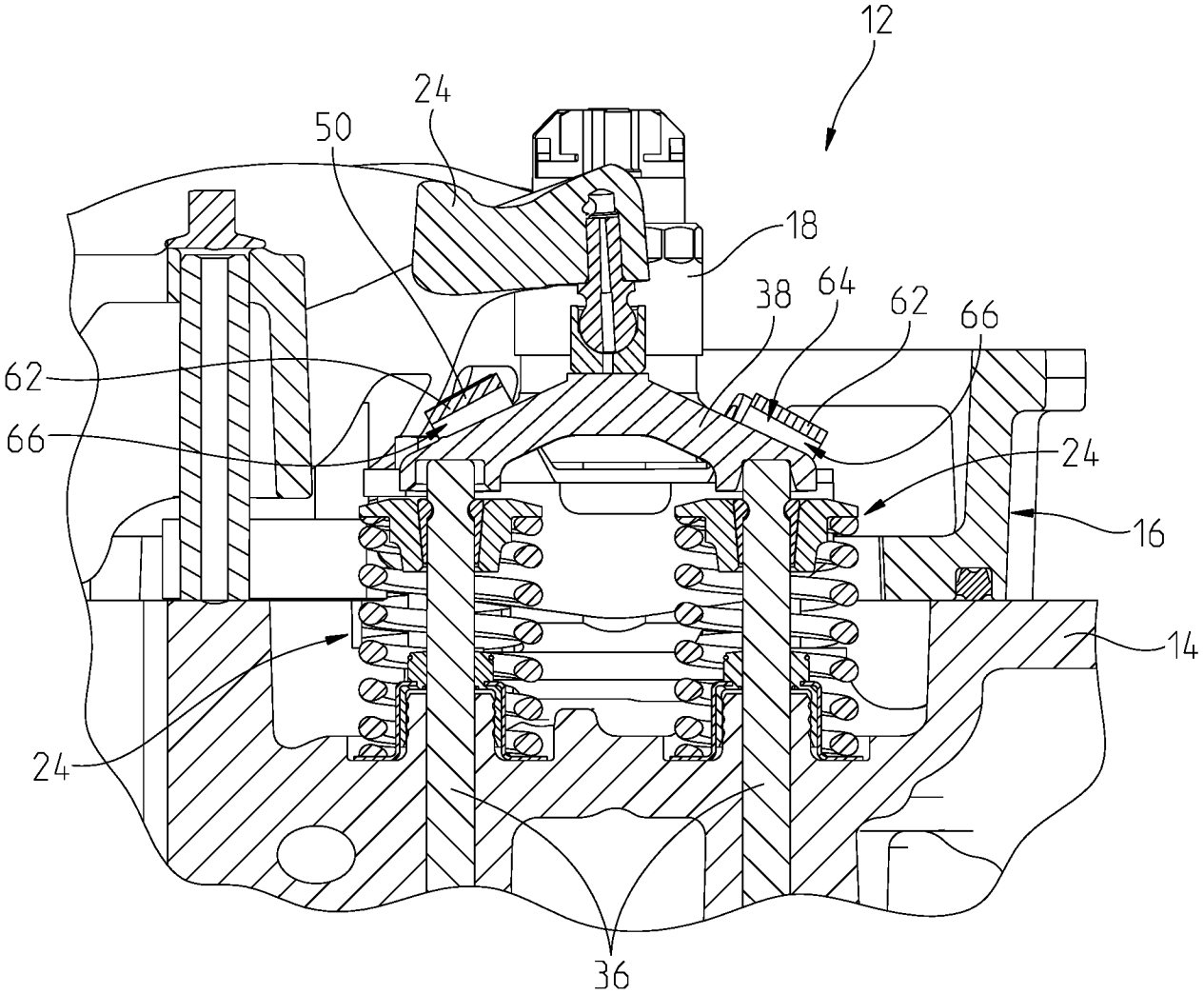
FIG. 4 is a cross-sectional view of the cylinder of FIG. 2, taken along line 4-4 of FIG. 2.
Figure 5:
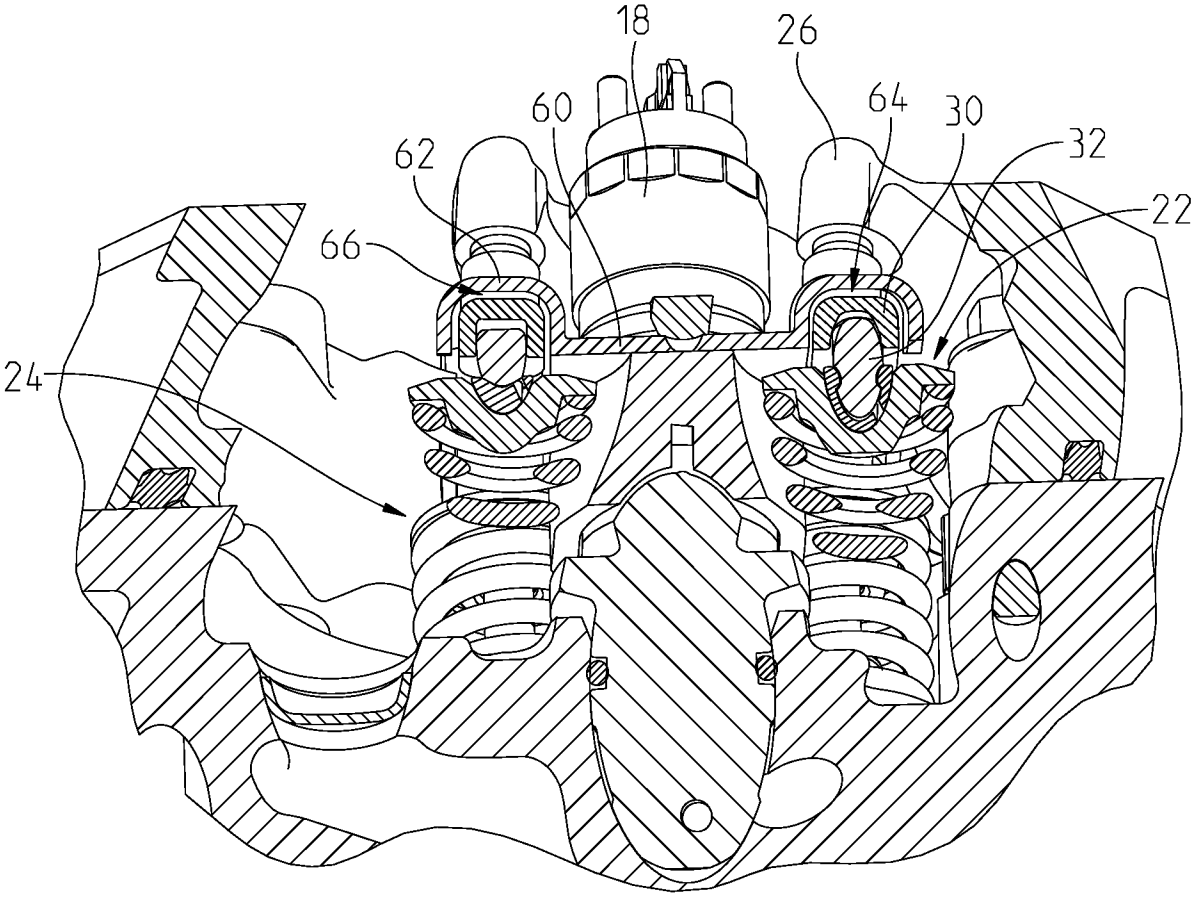
FIG. 5 is a cross-sectional view of the cylinder of FIG. 2, taken along line 5-5 of FIG. 2.
Figure 6:
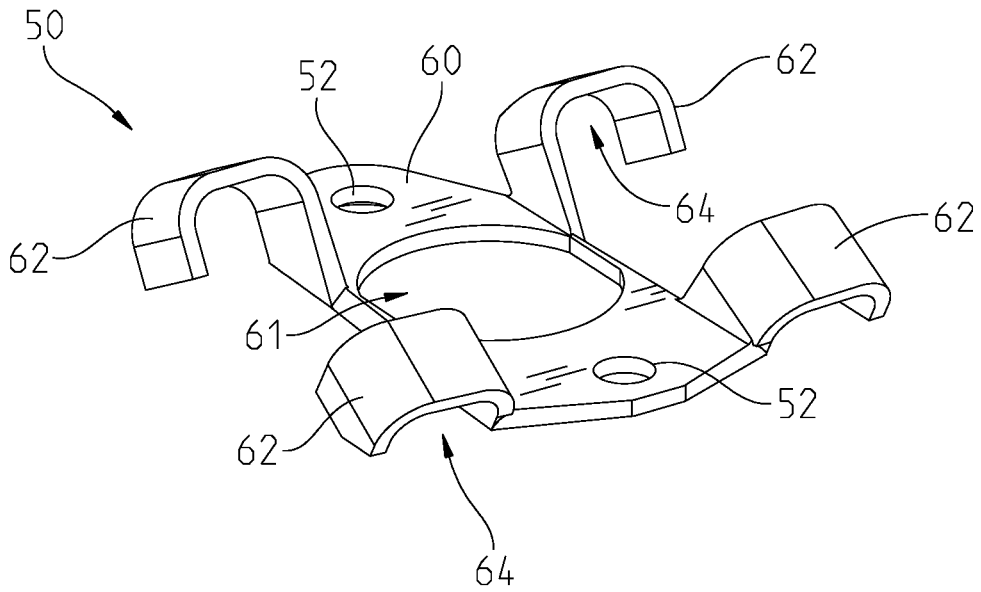
FIG. 6 is a perspective view of the mechanical retention member of FIG. 3.

Referring to FIGS. 4 and 5, while a portion of cross-heads 30, 38 is positioned within recessed portion 64 of each arm 62, arms 62 do not contact cross-heads 30, 38 during normal or routine operation of engine 10. More particularly, a gap 66 is defined between arm 62 and an upper surface of cross-head 30, 38. Gap 66 allows for cross-head 30,38 to move in the predetermined range of motion during normal or routine operation of engine 10 without any contact between cross-head 30, 38 and arm 62. In one embodiment, gap 66 may be approximately 0.01-5.0 mm and, more particularly, approximately 0.1-3.0 mm. For example, gap 66 may define the smallest available clearance between cross-heads 30, 38 and arms 62 that allows for the predetermined range or movement of cross-heads 30, 38 during normal or routine operation of engine 10, manufacturing tolerances, and expected thermal expansion of components. Additionally, it may be appreciated that retention member 50, including body portion 60 and arms 62, remains stationary during movement of cross-heads 30, 38 and does not move therewith.

If a failure or incorrect operation occurs with the hydraulic lash adjuster, then retention member 50 is configured to mechanically, rather than electronically or otherwise, retain cross-heads 30, 38 on valve tips 32, 40, respectively, and prevent cross-heads 30, 38 from falling off of respective valve tips 32, 40. More particularly, even though arms 62 do not contact cross-heads 30, 38 during normal or routine operation of engine 10 due to gap 66, if the hydraulic lash adjuster fails or operates incorrectly to cause excessive movement of cross-heads 30, 38, such that cross-heads 30, 38 contact arms 62, the contact between arms 62 and cross-heads 30, 38 prevents cross-heads 30, 38 from falling off of valve tips 32, 40, respectively. As such, the upside-down "U" shape of arms 62, which generally extends around a portion of cross-heads 30, 38, prevents rotational, lateral, and vertical movement of cross-heads 30, 38 relative to respective valve tips 32, 40 during lash. In this way, damage to engine 10 is minimized or prevented even if there is a failure or incorrect operation of the hydraulic lash adjuster.

It may be appreciated that the illustrative retention member 50 is configured to mechanically prevent separation of a portion of valvetrain assembly 20 from valves 22, 24 but is not a component of valvetrain assembly 20. In this way, retention member 50 does not add mass to valvetrain assembly 20 which allows engine 10 to operate at an expected speed (i.e., rpm valve or range) without any additional calibrations or adjustments to engine 10 to accommodate retention member 50.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A retention member configured to be supported within a cylinder head of an engine, comprising:
- a body portion having an opening configured to receive a fuel injector of the engine; and
- a plurality of arms extending from the body portion and configured to be positioned over a portion of a cross-head of the engine, the plurality of arms being spaced apart from the cross-head during routine operation of the engine.

2. The retention member of claim 1, wherein the body portion includes apertures configured to receive removable mechanical fasteners, and the body portion is removably coupled with the cylinder head through the removable mechanical fasteners.

3. The retention member of claim 1, wherein the body portion is integrally formed with the plurality of arms.

4. The retention member of claim 3, wherein the body portion and plurality of arms are comprised of a metallic stamping.

5. The retention member of claim 1, wherein each of the plurality of arms defines an upside-down U shape configured to receive a portion of the cross-head within a recess of the U shape.

6. The retention member of claim 1, wherein the body portion and the plurality of arms are stationary relative to movement of the cross-head.

7. The retention member of claim 1, wherein the plurality of arms is configured to retain a position of the cross-head during movement of the cross-head which contacts at least one of the plurality of arms.

8. The retention member of claim 1, wherein the body portion is coupled to a clamp of the fuel injector.

9. A retention member configured to be operably coupled to a valvetrain assembly of an engine, comprising:
- a body portion positioned intermediate a first valve and a second valve of the valvetrain assembly;
- a first plurality of arms configured to be positioned relative to the first valve; and
- a second plurality of arms configured to be positioned relative to the second valve, and the body portion, first plurality of arms, and second plurality of arms are stationary relative to movement of the first and second valves, wherein each of the first and second plurality of arms defines a recess configured to receive a portion of a cross-head of the valvetrain assembly.

10. The retention member of claim 9, wherein the body portion and the first and second plurality of arms are removable from the valvetrain assembly.

11. The retention member of claim 9, wherein the first and second plurality of arms are configured to retain a position of the cross-head during movement of the cross-head which contacts at least one of the arms.

12. The retention member of claim 9, wherein the first and second pluralities of arms are spaced apart from the cross-head during routine operation of the engine.

13. A retention member configured to be operably coupled to a valvetrain assembly of an engine, comprising:

a body portion positioned intermediate a first valve and a second valve of the valvetrain assembly;

a first plurality of arms configured to be positioned relative to the first valve; and a second plurality of arms configured to be positioned relative to the second valve, and the body portion, first plurality of arms, and second plurality of arms are stationary relative to movement of the first and second valves, wherein the body portion is configured to be removably coupled with a fuel injector of the engine.

14. An engine, comprising:

a cylinder having a body portion and a cylinder head portion configured to be coupled with the body portion;

a valvetrain assembly supported on at least a portion of the cylinder and including an intake valve, an exhaust valve, a first cross-head operably coupled to the intake valve, and a second cross-head operably coupled to the exhaust valve; and a retention member configured to maintain a position of the first and second cross-heads relative to the intake and exhaust valves, and the retention member is removable relative to the cross-heads.

15. The engine of claim 14, further comprising a fuel injector and the retention member is removably coupled to the fuel injector.

16. The engine of claim 14, wherein the retention member is stationary relative to movement of the cross-heads.

17. The engine of claim 14, wherein the retention member is configured to retain a position of at least one of the cross-heads during movement of the at least one of the cross-heads which contacts the retention member.

18. The engine of claim 14, wherein the retention member includes a body portion and a plurality of arms, and the plurality of arms is positioned above the cross-heads and spaced apart from the cross-heads by a gap.

19. The engine of claim 18, wherein each of the plurality of arms includes a recess configured to receive a portion of the cross-heads therein.

* * * * *